US007525105B2

(12) United States Patent
Kovtoun

(10) Patent No.: US 7,525,105 B2
(45) Date of Patent: Apr. 28, 2009

(54) LASER DESORPTION—ELECTROSPRAY ION (ESI) SOURCE FOR MASS SPECTROMETERS

(75) Inventor: Viatcheslav V. Kovtoun, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 249 days.

(21) Appl. No.: 11/799,910

(22) Filed: May 3, 2007

(65) Prior Publication Data

US 2008/0272294 A1 Nov. 6, 2008

(51) Int. Cl.
*H01J 27/24* (2006.01)

(52) U.S. Cl. ..... 250/425; 250/424; 250/288

(58) Field of Classification Search ..... 250/281, 250/282, 283, 288, 424, 425, 423 P
See application file for complete search history.

(56) References Cited

U.S. PATENT DOCUMENTS

| | | | | |
|---|---|---|---|---|
| 7,070,949 | B2 | 7/2006 | Suckau et al. | |
| 7,335,897 | B2 * | 2/2008 | Takats et al. | 250/425 |
| 2005/0199823 | A1 | 9/2005 | Franzen | |
| 2007/0176113 | A1 * | 8/2007 | Shiea et al. | 250/423 P |

OTHER PUBLICATIONS

Le Gac et al, "An Open Design Microfabricated Nib-Like Nanoelectrospray Emitter Tip on a Conducting Silicon Substrate for the Application of the Ionization Voltage," J Am Soc Mass Spectrom, Elsevier Inc, p. 75-80, (2006).
Cole, Richard, "Electrospray vs. MALDI: Comparing Capabilities and Limitations," Preceedings of the 42nd ASMS Conference on Mass Spectrometry and Allied Topics, p. 1193, (1999).
Wilm et al., "Analytical Properties of the Nanoelectrospray Ion Source," Anal. Chem. , vol. 68 ( No. 1), p. 1-8, (1996).
Juraschek et al., "Nanoelectrospray—More Than Just a Minimized-Flow Electrospray Ionization Source," J Am Soc Mass Spectrom, Elsevier Science Inc., p. 300-308, (1999).
Shiea et al, "Electrospray-assisted laser desorption/ionization mass spectrometry for direct ambient analysis of solids," Rapid Commun, Mass Spectrom., Wiley Interscience (No. 19), p. 3701-3704, (2005).

* cited by examiner

*Primary Examiner*—David A Vanore
*Assistant Examiner*—Michael Maskell
(74) *Attorney, Agent, or Firm*—Charles B. Katz; Bradley W. Scheer

(57) ABSTRACT

An ion source is disclosed for forming multiply-charged analyte ions from a solid sample. A beam of pulsed radiation is directed onto a portion of the sample to desorb analyte molecules. A retaining structure holding a solvent volume is positioned proximate the sample. Desorbed analyte molecules contact a free surface of the solvent and pass into solution. The solution is then conveyed through an outlet passageway to an electrospray apparatus, which introduces a spray of charged solvent droplets into an ionization chamber.

14 Claims, 3 Drawing Sheets

LASER DESORPTION—ELECTROSPRAY ION (ESI) SOURCE FOR MASS SPECTROMETERS

TECHNICAL FIELD

The present invention is related to ion sources for mass spectrometers, and more particularly to a laser desorption source capable of producing multiply charged analyte ions from a sample.

BACKGROUND

Mass spectrometers are widely used instruments for providing information about the nature and structure of molecules, including large biomolecules such as peptides or proteins. An important component in the construction of a mass spectrometer system is a source for producing ions of the molecule or molecules of interest (i.e., the analyte molecules) to enable subsequent separation and detection by mass spectrometry.

Matrix assisted laser desorption and ionization (MALDI) is one well-known technique for the production of analyte ions. The MALDI process may be conceptualized as having two steps. In a first step, the analyte is mixed with a solvent containing small organic molecules in solution, called a matrix. The matrix is chosen to have a strong absorption at the specific wavelength of a laser used in the second step. The mixture is dried prior to analysis, removing any liquids used in preparation of the solution. The result is a solid deposit of an analyte-doped matrix, where the analyte molecules are embedded throughout the matrix and where the analyte molecules are isolated from each other. In a second step of the MALDI process, intense pulses of the laser are directed at the analyte-doped matrix. The pulses cause ablation of bulk portions of the solid solution. The rapid heating causes localized sublimation of the matrix and expansion of sublimated matrix portions into a gas phase, entraining intact analyte. Ionization reactions occur during or prior to this process and produce the analyte ions, which are subsequently conveyed to a mass analyzer for determination of the mass-to-charge ratios (m/z's) of the analyte ions and/or its products.

The MALDI technique offers important advantages relative to alternative ionization techniques, such as electrospray ionization (ESI), which are tied to the time limitations of the chromatographic separation process. Standard sample preparation methods developed for MALDI, provide for easy storage of prepared samples and enable samples of interest to be re-analyzed at any suitable time. The pulsed operation of MALDI gives an opportunity to look closely into specific compounds without being restricted to analysis the time period defined by an elution peak. These features of MALDI found further development in LC-MALDI technique which breaks chromatographic elution process into a number of short time events frozen as separate samples on a MALDI plate.

Certain limitations in the use of the conventional MALDI technique arise from its inability to produce multiply charged analyte ions. There has been recent interest in utilizing advanced fragmentation techniques based on ion-electron and ion-ion reactions, such as electron capture dissociation (ECD) and electron transfer dissociation (ETD), which are characterized by a significant improvement in efficiency of fragmentation with increased charge state of analyte ions. Furthermore, many commercially available mass analyzers are limited in operation to ions having m/z's within a specified range (e.g., below 3000 Th), rendering analysis of large biomolecules by MALDI-based mass spectrometry difficult or impossible.

One approach to adapting the standard MALDI technique for production of multiply charged ions is described in U.S. Patent Application Publication No. US2005/0199823 by Jochen Franzen. This reference discloses an ion source in which analyte molecules are desorbed from the surface of a solid sample (using a pulsed laser) in close proximity to a spray of charged solvent droplets emanating from a conventional electrospray capillary. A portion of the desorbed analyte molecules are protonized (purportedly by interaction with either the charged droplets or free proton-water complexes vaporized from the droplets) and form multiply-charged analyte ions. While this method appears to be somewhat successful in producing the desired multiply-charged ions, it is believed that ionization efficiencies achieved using this method are highly sensitive to variations in spray conditions (more specifically, the concentration and size dispersion of small, highly-charged droplets near the sample surface and efficiency of ion transport and incorporation into the droplets), and that departures from optimal conditions may have a substantial adverse effect on the production of multiply-charged ions and hence overall mass spectrometer performance.

SUMMARY OF THE INVENTION

Roughly described, an embodiment of the present invention provides a mass spectrometer ion source for generating multiply charged analyte ions from a sample. The apparatus includes a pulsed laser or similar radiation source for irradiating a sample, causing analyte molecules to be desorbed from the sample surface. A retaining structure holds a solvent volume near the sample. Desorbed analyte molecules contact the surface of the solvent volume and pass into solution. The solution, containing the analyte molecules, is conveyed through an outlet passageway to a spray orifice. At least part of the outlet passageway is maintained at an elevated potential relative to other surfaces of an ionization chamber so that the solvent exits the spray orifice as a spray of charged droplets. Multiply-charged analyte ions are formed as the solvent vaporizes, and these multiply-charged ions may then be transported to a mass analyzer for measurement of the mass-to-charge ratios of the analyte ions and/or their products.

The retaining structure may be implemented in a variety of geometries and configurations. In one implementation, the retaining structure includes an inner narrow-bore tube that serves as the outlet passageway and an annular region exterior to the inner tube through which the solvent is supplied. The annular region may be defined by an outer tube arranged co-axially with the inner tube. The inner and outer tubes terminate in substantially co-planar open ends from which the solvent protrudes slightly toward the sample. The pressure gradient required to draw the resultant solution through the outlet passageway to the spray orifice may be generated by a nebulizer structure positioned adjacent to the spray orifice through which a nebulizing gas flows at high velocity. Alternatively, the retaining structure may be implemented as an open loop for forming the solvent volume as a thin film, such that dilution of the analyte molecules in the solvent is minimized.

DETAILED DESCRIPTION

Figure 1:
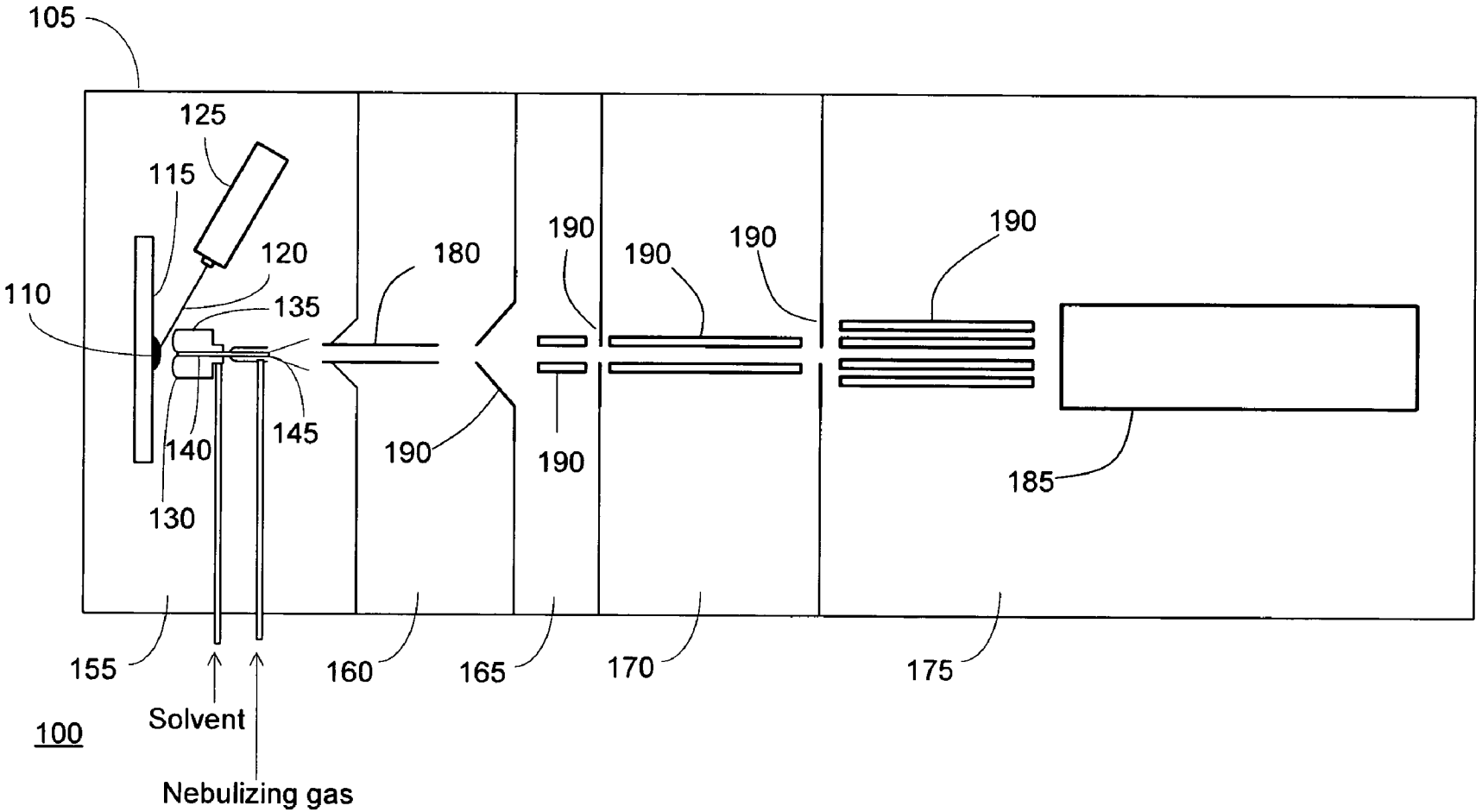
FIG. 1 is a schematic diagram of a mass spectrometer having a LD-ESI ion source constructed in accordance with an embodiment of the invention.

FIG. 1 is an overall schematic depiction of a mass spectrometer 100 utilizing a laser desorption-electrospray ion (LD-ESI) source 105 in accordance with an illustrative embodiment of the invention. A condensed-phase (solid or liquid) sample 110 is disposed on a sample support 115 and aligned with a radiation beam 120 emitted by a radiation source, such as laser 125. Irradiation of the sample causes analyte molecules to be desorbed from the surface. At least a portion of the desorbed analyte molecules contact a free surface of a solvent volume 130 held in close proximity to sample 110 by retaining structure 135 and are absorbed into solution. The solution containing the analyte molecules is drawn through an outlet passageway defined by central tube 140 and is conveyed therethrough to spray orifice 145. The central tube 140 (or the distal portion thereof) is maintained at an appropriate potential relative to other elements within ionization chamber 155 (the interior of which will typically be maintained at or close to atmospheric pressure) such that droplets emitted from spray orifice 145 carry an electrical charge. The charged droplets undergo size reduction by a combination of solvent evaporation and Coulomb explosions, ultimately resulting in the production of analyte ions. For analyte molecules having a plurality of ionizable sites, at least a portion of the analyte ions will be multiply charged. Analyte ions are directed into a reduced pressure chamber 160 under the influence of a pressure gradient and electrostatic fields, and are thereafter delivered through chambers 165 and 170 of progressively lower pressure to vacuum chamber 175, in which is situated at least one mass analyzer 185. An ion transport tube 180 and various ion optical components 190 (which may include DC-only lenses together with radio-frequency ion guides) are provided to assist in the transport and focusing of the analyte ions. Mass analyzer 185 may be of any suitable type or combination of types, including but not limited to a quadruple mass filter, quadrupole ion trap, time-of-flight (TOF), Orbitrap or other electrostatic trap, or Fourier Transform/Ion Cyclotron Resonance (FTICR) analyzer. Mass analyzer 185 may be configured to perform one or more stages of fragmentation to effect MS/MS or MSn analysis of the analyte ions, using any appropriate fragmentation technique (such as the aforementioned ECD and ETD techniques, and other known techniques such as collision-induced dissociation (CID) and photo-induced dissociation. It should be understood that the mass spectrometer architecture depicted in FIG. 1 is presented only by way of an illustrative example, and that the LD-ESI source described herein may be used in connection with a variety of instrument architectures.

Figure 2:
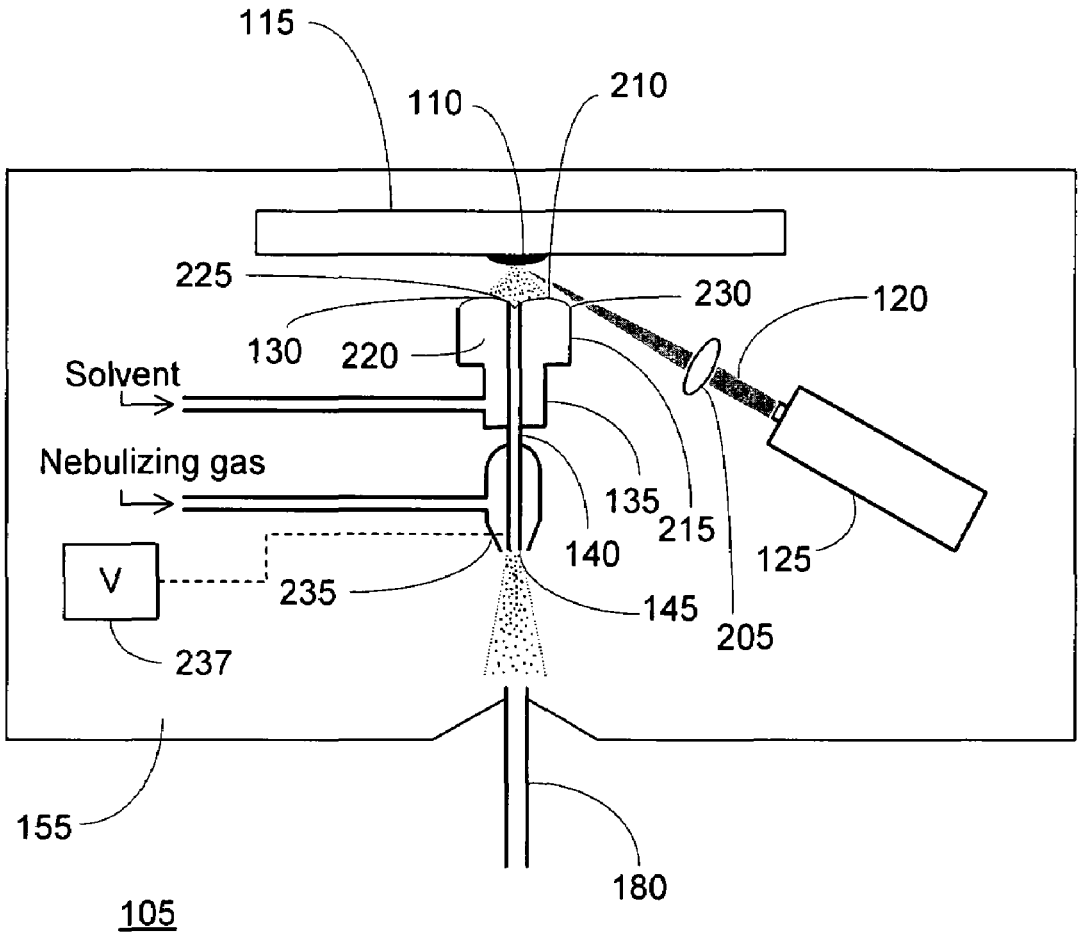
FIG. 2 is a schematic cross-sectional diagram showing details of the LD-ESI ion source of FIG. 1.

FIG. 2 depicts LD-ESI source 105 and associated components in greater detail. Sample support 115 may take the form of a conventional MALDI plate on which a large number of samples (including sample 110) are deposited in an array using conventional manual or automated methods. Sample support 115 may be mounted to a positioning mechanism (not depicted) that is controllably movable to align the laser beam with a selected sample or region of the sample. If the analyte substance is weakly absorbing at the wavelength of radiation beam 120, then sample 110 may be prepared by mixing a solution of the analyte substance with a strongly-absorbing matrix material (such as DHB (2,5-dihydrobenzoic acid) or α-CHA (α-cyano-4-hydroxycinnamic acid)) and evaporating the solvent, thereby forming a sample spot of co-crystallized analyte and matrix molecules. Alternatively, the sample may be in the form of a liquid solution comprising analyte and matrix molecules dispersed in a solvent. In another example, sample 110 may take the form of a thin slice of intact biological tissue, which may be overlaid with a layer of matrix material to improve beam absorption.

Laser 120, which may be a gas (e.g., nitrogen) or solid state (e.g., Nd:YAG or Nd:YLF) laser, emits a pulsed radiation beam 120 of suitable wavelength and power to ablate analyte molecules from sample 110. Radiation beam 120 may propagate through free space or may alternatively be directed through an optical fiber. One or more lenses 205 may be provided to focus beam 120 onto the sample surface. Depending on the beam fluence and the absorbance and other physical and chemical properties of sample 110, analyte molecules desorbed from the sample may be neutral or charged, and may also be associated into neutral or charged clusters with molecules of solvent, matrix material, or impurities (e.g., salts). It is noted that, in contrast to a conventional MALDI source, the beam 120 does not need to have sufficient power to produce ionization of the desorbed molecules (since ionization occurs in the succeeding electrospray process, as described below), which permits the use of a lower-power (and hence potentially cheaper) laser than is required for MALDI. Furthermore, the use of a lower-power laser reduces (relative to conventional MALDI) the undesired fragmentation of fragile analyte molecules within the source region, thereby increasing the number of intact molecular ions available for analysis.

Retaining structure 135 is positioned and configured to hold a solvent volume 130 having a free surface 210 in close proximity to sample 110, such that a relatively large fraction of the desorbed analyte molecules come into contact with the solvent volume. In a typical implementation, the distance between sample 110 and free surface 210 is approximately one millimeter (1 mm). Retaining structure includes central tube 140 positioned within an external tube 215, which define therebetween an annular conduit 220 through which solvent flows toward solvent volume 130. According to a specific construction of retaining structure 135, central tube 140 has an inner diameter of about 20-50 μm and external tube 215 has an inner diameter of about 2-3 mm. Central tube 140 and external tube 215 terminate respectively in open ends 225 and 230, which are substantially co-planar. A frit may be placed in annular conduit 220 adjacent open ends 225 and 230 to facilitate formation of a stable solvent volume.

Solvent may be continuously delivered to annular conduit 220 via a supply tube 225 connected to an external solvent source. The solvent will typically comprise water, methanol or acetonitrile (or a combination thereof), but other liquids having suitable properties may also be used. By appropriate selection and/or control of various operational and design parameters (solvent flow rate, outlet flow rate, material wettability), solvent volume 130, the shape and position of solvent volume 130 may be held stable. Due to the surface tension of the solvent liquid, free surface 210 may protrude slightly from open ends 225 and 230 toward sample 110.

Material ablated from sample 110 forms a generally conical plume, as indicated by FIG. 2. To promote capture of analyte molecules, the dimensions and positioning of retaining structure 135 may be selected such that the width of solvent volume 130 is generally co-extensive with the plume. A portion of the analyte molecules (which, as discussed above, may include neutral and charged clusters) contacting free surface 210 interact with the solvent and pass into solution. The solution containing the analyte molecules enters central tube 140 through open end 225 and is drawn through the tube under the influence of a pressure gradient or other motive force toward spray orifice 145. In this embodiment, the pressure gradient is generated by providing a nebulizer nozzle 235 near the distal end of central tube 140. A gas, such as nitrogen, is introduced into nebulizer nozzle 235 from an external source and flows at high velocity past spray orifice 145, thereby reducing the pressure in the region adjacent to spray orifice 145 by the venture effect. In an alternative embodiment, the pressure gradient for moving solution through central tube 140 may be achieved by providing a partition within ionization chamber 155 to divide the chamber into a first region in which sample 110 and solvent volume 130 are located and a second region in which spray orifice 145 is located, with central tube 140 extending between the first and second regions, and either raising the pressure within the first region or reducing the pressure within the second region, using a pump or similar device. In other alternative embodiments, a piezoelectric transducer or other electromechanical structure may be utilized to provide the motive force for drawing the solution through central tube 140 and expelling it as droplets from spray orifice 145.

Voltage source 237 applies an electrical potential of appropriate magnitude and polarity (relative to other surfaces or electrodes within chamber 155) to central tube 140 in order to generate a strong electrical field that causes charging of the droplets leaving spray orifice 145. It will usually be necessary or advantageous to isolate other components of LD-ESI source 105 from the voltage applied to central tube 140; for this reason, central tube 140 may be constructed in multiple segments with only the distal segment being conductive. The charged droplets emerging from spray orifice 145 form a spray cone 240. Supplemental heated gas flows may be directed into ionization chamber 155 to accelerate the solvent evaporation process. As is known in the electrospray art, production of analyte ions occurs when the electric field on the droplet becomes sufficiently great, and multiply charged ions are formed for large analyte molecules, such as proteins and peptides, having several ionizable sites. Thus formed, the analyte ions enter ion transport tube 180 (under the influence of a pressure gradient and possibly electrostatic fields and are thereafter transported through several intermediate regions to mass analyzer 185.

Figure 3A:
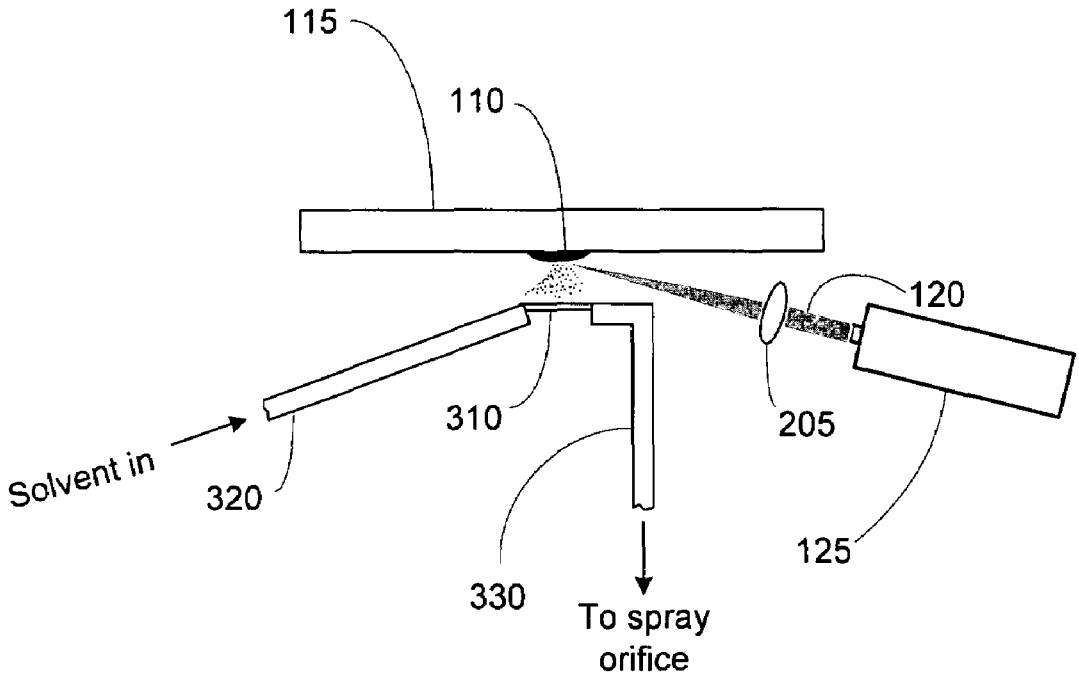
FIGS. 3A and 3B depict (in schematic cross-sectional and elevated plan views, respectively) an alternative embodiment of an LD-ESI source in which a retaining structure is configured to form a thin film of solvent.
Figure 3B:
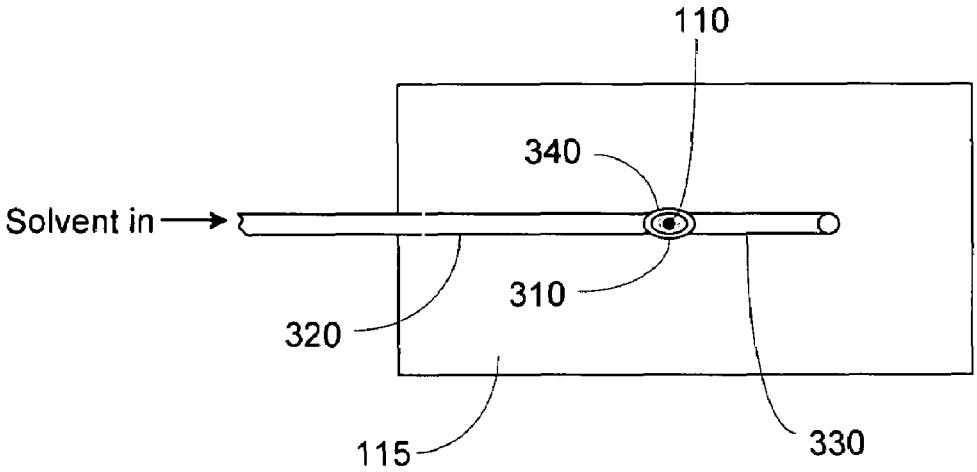

It is generally desirable to minimize the quantity of solvent in which the analyte molecules are dissolved, thereby delivering to the spray orifice a solution having a relatively high concentration of the analyte molecules. This objective may be served by configuring the solvent volume as a thin film, in the manner depicted in FIGS. 3A and 3B. Solvent is supplied to a retaining structure 310 via an inlet conduit 320. Retaining structure 310 is constructed as an open frame which receives the solvent from an end of inlet conduit 320. The open interior area of retaining structure 310 may be underlain by a mesh material. In order to prevent sample cross-contamination, retaining structure 310 may be formed as a disposable unit, such that the retaining structure may be replaced each time a new sample or set of samples is analyzed. The flowing solvent forms a thin film solvent volume 340 extending interiorly within the open frame structure. Preferably, the dimensions and spacing of retaining structure 310 relative to sample 110 are selected such that the thin film solvent volume has a lateral width that is roughly co-extensive with the width of the plume of desorbed analyte molecules formed by irradiation with laser 125, so that a relatively large fraction of the desorbed analyte molecules come into contact with the surface of the thin film. Because the thin film solvent volume comprises a very small quantity of solvent, the solution resulting from the acceptance of the analyte molecules into solution will have a relatively high analyte concentration. The solution passes into an end of an outlet tube 330 or other conduit forming an outlet passageway, and is drawn through outlet tube 330 by a pressure gradient or other motive force, in the manner discussed above in connection with the FIG. 2 embodiment. The solution is then expelled as a spray of charged droplets from a spray orifice (not depicted) located at the distal end of outlet tube 330, and analyte ions are produced as the droplets shrink by evaporation and Coulomb explosions, again as discussed above.

It will be appreciated that various means can be employed to improve the efficiency of collection of the desorbed analyte molecules on the accepting area of the solvent volume, including without limitation directing gas flows in the vicinity of retaining structure 310.

In the foregoing specification, the present invention has been described with reference to specific embodiments thereof. It will, however, be evident to a skilled artisan that various modifications and changes can be made thereto without departing from the broader spirit and scope of the present invention as set forth in the appended claims.

What is claimed is:

1. An ion source, comprising:

a radiation source configured to direct a radiation beam onto a sample to cause analyte molecules to be desorbed from the sample;

a retaining structure for holding a solvent volume proximate to the sample, such that a portion of the desorbed analyte molecules contact the solvent volume and form a solution containing analyte molecules; and an outlet passageway for conveying the solution to a spray orifice; and a voltage source for maintaining at least a portion of the passageway at a potential appropriate for causing charged droplets to be emitted from the spray orifice;

whereby multiply charged analyte ions are formed from the charged droplets.

2. The ion source of claim 1, wherein the radiation source comprises a pulsed laser.

3. The ion source of claim 1, wherein the retaining structure includes a supply conduit for continuously or periodically replenishing the solvent volume.

4. The ion source of claim 1, wherein the retaining structure is configured to hold the solvent volume in the form of a thin film.

5. The ion source of claim 3, wherein the supply conduit is arranged annularly about the outlet passageway.

6. The ion source of claim 5, further comprising a frit disposed in an annular space between the supply conduit and the outlet passageway.

7. The ion source of claim 1, further comprising a nozzle positioned proximate to a distal end of the outlet passageway, the nozzle being configured to direct a flow of gas at high velocity past the spray orifice to reduce the pressure at the spray orifice in order to draw the solution through the outlet passageway.

8. The ion source of claim 1, wherein the sample is supported on an adjustably positionable plate.

9. The ion source of claim 1, wherein the solvent volume and spray orifice are respectively located in first and second regions separated by a partition, and further comprising means for reducing the maintaining the pressure of the second region lower than the pressure of the first region, such that the solution is drawn through the outlet passageway.

10. A method for forming multiply charged ions from a sample, comprising steps of:

desorbing analyte molecules from the sample;

contacting a portion of the analyte molecules with a solvent volume positioned proximate to the sample to form a solution containing the analyte molecules;

conveying the solution through an outlet passageway to a spray office; and generating a spray of charged droplets of the solution.

11. The method of claim 10, wherein the step of generating a spray of charged droplets includes:

maintaining at least a portion of the outlet passageway at a potential appropriate for causing charged droplets to be formed.

12. The method of claim 10, wherein the step of desorbing analyte molecules includes directing a pulsed beam of radiation onto the sample.

13. The method of claim 10, wherein the step of generating a spray of charged droplets comprises directing a flow of nebulizing gas past a spray orifice.

14. The method of claim 10, further comprising a step of periodically or continuously replenishing the solvent volume.

* * * * *

UNITED STATES PATENT AND TRADEMARK OFFICE

CERTIFICATE OF CORRECTION

PATENT NO. : 7,525,105 B2
APPLICATION NO. : 11/799910
DATED : April 28, 2009
INVENTOR(S) : Viatcheslav V. Kovtoun It is certified that error appears in the above-identified patent and that said Letters Patent is hereby corrected as shown below:

Claim 10, column 7, line 14
replace "spray office"
with -- spray orifice --

Signed and Sealed this

Thirtieth Day of June, 2009

JOHN DOLL
*Acting Director of the United States Patent and Trademark Office*